US009961941B2

(12) United States Patent
Tucker et al.

(10) Patent No.: US 9,961,941 B2
(45) Date of Patent: May 8, 2018

(54) ELECTRONIC SMOKING ARTICLE

(71) Applicant: Altria Client Services LLC, Richmond, VA (US)

(72) Inventors: Christopher S. Tucker, Midlothian, VA (US); Gerd Kobal, Sandy Hook, VA (US); Geoffrey Brandon Jordan, Midlothian, VA (US); Victor Kasoff, Austin, TX (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 0 days. days.

(21) Appl. No.: 15/360,383

(22) Filed: Nov. 23, 2016

(65) Prior Publication Data

US 2017/0071261 A1 Mar. 16, 2017

Related U.S. Application Data

(62) Division of application No. 13/774,364, filed on Feb. 22, 2013, now Pat. No. 9,532,597.

(60) Provisional application No. 61/601,903, filed on Feb. 22, 2012.

(51) Int. Cl.
*A24F 47/00* (2006.01)

(52) U.S. Cl.
CPC ..... *A24F 47/008* (2013.01); *A24F 47/004* (2013.01)

(58) Field of Classification Search
CPC ..... A61M 15/06; A24F 47/002; A24F 47/004; A24F 47/008
See application file for complete search history.

(56) References Cited

U.S. PATENT DOCUMENTS

| | | | |
|---|---|---|---|
| 1,771,366 | A | 7/1930 | Wyss et al. |
| 1,968,509 | A | 7/1934 | Tiffany |
| 2,057,353 | A | 10/1936 | Whittlemore, Jr. |
| 2,104,266 | A | 1/1938 | McCormick |
| 2,406,275 | A | 8/1946 | Wejnarth |
| 2,442,004 | A | 5/1948 | Hayward-Butt |
| 2,558,127 | A | 6/1951 | Downs |
| 2,642,313 | A | 6/1953 | Montenier |
| 2,728,981 | A | 1/1956 | Hooper |
| 2,830,597 | A | 4/1958 | Kummli |

(Continued)

FOREIGN PATENT DOCUMENTS

| | | | |
|---|---|---|---|
| BE | 421623 | A | 6/1937 |
| CH | 421786 | A | 9/1966 |

(Continued)

OTHER PUBLICATIONS

Japanese Office Action dated Feb. 14, 2017 in related Japanese Application No. 2014-558891.

(Continued)

*Primary Examiner* — Jason L Lazorcik
(74) *Attorney, Agent, or Firm* — Harness, Dickey & Pierce, P.L.C.

(57) ABSTRACT

An electronic cigarette includes a capillary tube in communication with a liquid supply including liquid material and a heater operable to heat the capillary tube to a temperature sufficient to vaporize the liquid material contained therein and form an aerosol. The liquid supply is adapted to be squeezed or otherwise compressed so as to allow a smoker to manually pump liquid to the capillary tube and simultaneously activate the heater.

18 Claims, 2 Drawing Sheets

(56) References Cited

U.S. PATENT DOCUMENTS 2,907,686 A 10/1959 Siegel
2,971,039 A 2/1961 Western
2,972,557 A 2/1961 Toulmin, Jr.
2,974,669 A 3/1961 Ellis
3,062,218 A 11/1962 Temkovits
3,200,819 A 8/1965 Gilbert
3,255,760 A 6/1966 Selker
3,258,015 A 6/1966 Ellis et al.
3,356,094 A 12/1967 Ellis et al.
3,363,633 A 1/1968 Weber
3,402,723 A 9/1968 Hu
3,425,414 A 2/1969 La Roche
3,482,580 A 12/1969 Hollabaugh
3,521,643 A 7/1970 Toth
3,812,854 A 5/1974 Michaels et al.
3,878,041 A 4/1975 Leitnaker et al.
4,068,672 A 1/1978 Guerra
4,077,784 A 3/1978 Vayrynen
4,083,372 A 4/1978 Boden
4,131,119 A 12/1978 Blasutti
4,141,369 A 2/1979 Burruss
4,164,230 A 8/1979 Pearlman
4,193,411 A 3/1980 Faris et al.
4,219,032 A 8/1980 Tabatznik et al.
4,246,913 A 1/1981 Ogden et al.
4,259,970 A 4/1981 Green, Jr.
4,419,302 A 12/1983 Nishino et al.
4,735,217 A 4/1988 Gerth et al.
4,765,347 A 8/1988 Sensabaugh, Jr. et al.
4,804,002 A 2/1989 Herron
4,911,181 A * 3/1990 Vromen ..... A24F 47/002 131/270
4,922,901 A 5/1990 Brooks et al.
4,945,929 A 8/1990 Egilmex
4,945,931 A * 8/1990 Gori ..... A24F 47/008 131/194
4,947,874 A 8/1990 Brooks et al.
4,947,875 A 8/1990 Brooks et al.
4,961,727 A 10/1990 Beard
4,981,522 A 1/1991 Nichols et al.
4,991,606 A 2/1991 Serrano et al.
4,993,436 A * 2/1991 Bloom, Jr. ..... A24F 47/002 128/200.14
5,016,656 A 5/1991 McMurtrie
5,040,552 A 8/1991 Schleich et al.
5,042,510 A 8/1991 Curtiss et al.
5,060,671 A 10/1991 Counts et al.
5,085,804 A 2/1992 Washburn
5,093,894 A 3/1992 Deevi et al.
5,095,921 A 3/1992 Losee et al.
5,139,594 A 8/1992 Rabin
5,144,962 A * 9/1992 Counts ..... A24F 47/008 128/200.14
5,159,940 A 11/1992 Hayward et al.
5,179,966 A 1/1993 Losee et al.
5,224,498 A 7/1993 Deevi et al.
5,228,460 A 7/1993 Sprinkel et al.
5,235,157 A 8/1993 Blackburn
5,249,586 A 10/1993 Morgan et al.
5,269,327 A 12/1993 Counts et al.
5,322,075 A 6/1994 Deevi et al.
5,353,813 A 10/1994 Deevi et al.
5,369,723 A 11/1994 Counts et al.
5,388,594 A 2/1995 Counts et al.
5,396,911 A 3/1995 Casey, III et al.
5,404,871 A 4/1995 Goodman et al.
5,408,574 A 4/1995 Deevi et al.
5,473,251 A 12/1995 Mori
5,498,855 A 3/1996 Deevi et al.
5,505,214 A 4/1996 Collins et al.
5,542,410 A 8/1996 Goodman et al.
5,591,368 A 1/1997 Fleischhauer et al.
5,613,504 A 3/1997 Collins et al.
5,665,262 A 9/1997 Hajaligol et al.
5,666,977 A 9/1997 Higgins et al.
5,666,978 A 9/1997 Counts et al.
5,743,251 A * 4/1998 Howell ..... A61M 11/041 128/200.14
5,797,390 A 8/1998 McSoley
5,865,185 A 2/1999 Collins et al.
5,865,186 A * 2/1999 Volsey, II ..... A24F 47/006 131/194
5,878,752 A 3/1999 Adams et al.
5,894,841 A 4/1999 Voges
5,935,975 A 8/1999 Rose et al.
6,155,268 A 12/2000 Takeuchi
6,196,218 B1 3/2001 Voges
6,443,146 B1 9/2002 Voges
6,460,781 B1 10/2002 Garcia et al.
6,501,052 B2 12/2002 Cox et al.
6,516,796 B1 * 2/2003 Cox ..... A61M 15/0003 128/200.23
6,532,965 B1 3/2003 Abhulimen et al.
6,568,390 B2 5/2003 Nichols et al.
6,598,607 B2 7/2003 Adiga et al.
6,663,019 B2 12/2003 Garcia et al.
6,715,487 B2 4/2004 Nichols et al.
6,715,697 B2 4/2004 Duqueroie
6,772,756 B2 8/2004 Shayan
6,810,883 B2 11/2004 Felter et al.
6,854,470 B1 2/2005 Pu
6,883,516 B2 4/2005 Hindle et al.
7,117,867 B2 10/2006 Cox et al.
7,131,599 B2 11/2006 Katase
7,167,641 B2 1/2007 Tam et al.
7,173,222 B2 2/2007 Cox et al.
7,458,374 B2 12/2008 Hale et al.
D590,988 S 4/2009 Hon
D590,989 S 4/2009 Hon
D590,990 S 4/2009 Hon
D590,991 S 4/2009 Hon
7,614,402 B2 11/2009 Gomes
7,726,320 B2 6/2010 Robinson et al.
7,780,041 B2 8/2010 Albisetti
7,832,410 B2 11/2010 Hon
7,845,359 B2 12/2010 Montaser
7,913,688 B2 3/2011 Cross et al.
7,920,777 B2 4/2011 Rabin et al.
7,997,280 B2 8/2011 Rosenthal
8,079,371 B2 12/2011 Robinson et al.
8,127,772 B2 3/2012 Montaser
8,156,944 B2 4/2012 Han
8,205,622 B2 6/2012 Pan
8,258,192 B2 9/2012 Wu et al.
8,314,591 B2 11/2012 Terry et al.
8,365,742 B2 2/2013 Hon
8,371,310 B2 2/2013 Brenneise
8,375,957 B2 2/2013 Hon
8,393,331 B2 3/2013 Hon
D684,311 S 6/2013 Liu
8,459,270 B2 6/2013 Coven et al.
8,499,766 B1 8/2013 Newton
8,511,318 B2 8/2013 Hon
8,528,569 B1 9/2013 Newton
8,530,463 B2 9/2013 Cartt et al.
8,550,068 B2 10/2013 Terry et al.
8,550,069 B2 10/2013 Alelov
8,689,805 B2 4/2014 Hon
9,050,431 B2 * 6/2015 Turner ..... A61M 15/009
2002/0071871 A1 6/2002 Snyder et al.
2003/0108342 A1 6/2003 Sherwood et al.
2003/0150451 A1 8/2003 Shayan
2004/0020500 A1 2/2004 Wrenn et al.
2004/0050396 A1 3/2004 Squeo
2005/0016550 A1 1/2005 Katase
2005/0150489 A1 7/2005 Dunfield et al.
2006/0191546 A1 8/2006 Takano et al.
2006/0196518 A1 * 9/2006 Hon ..... A24F 47/002 131/360
2007/0102013 A1 5/2007 Adams et al.
2007/0267032 A1 11/2007 Shan
2008/0022999 A1 1/2008 Belcastro et al.
2008/0029084 A1 2/2008 Costantino et al.
2008/0230052 A1 9/2008 Montaser

(56) References Cited

U.S. PATENT DOCUMENTS

2008/0247892 A1 10/2008 Kawasumi
2009/0056729 A1 3/2009 Zawadzki et al.
2009/0095287 A1 4/2009 Emarlou
2009/0126745 A1 5/2009 Hon
2009/0151717 A1 6/2009 Bowen et al.
2009/0162294 A1 6/2009 Werner
2009/0188490 A1 7/2009 Han
2009/0230117 A1 9/2009 Fernando et al.
2009/0272379 A1 11/2009 Thorens et al.
2009/0283103 A1 11/2009 Nielsen et al.
2010/0031968 A1 2/2010 Sheikh et al.
2010/0083959 A1* 4/2010 Siller ..... A24F 47/006 128/202.21
2010/0126505 A1 5/2010 Rinker
2010/0200008 A1 8/2010 Taieb
2010/0206317 A1 8/2010 Albino et al.
2010/0229881 A1* 9/2010 Hearn ..... A24F 47/002 131/273
2010/0242975 A1* 9/2010 Hearn ..... A24F 47/002 131/273
2010/0242976 A1 9/2010 Katayama et al.
2010/0307518 A1 12/2010 Wang
2011/0005535 A1* 1/2011 Xiu ..... A24F 47/008 131/273
2011/0011396 A1 1/2011 Fang
2011/0036346 A1 2/2011 Cohen et al.
2011/0036363 A1 2/2011 Urtsev et al.
2011/0041858 A1 2/2011 Montaser
2011/0094523 A1 4/2011 Thorens et al.
2011/0120455 A1 5/2011 Murphy
2011/0120482 A1 5/2011 Brenneise
2011/0147486 A1 6/2011 Greim et al.
2011/0155153 A1 6/2011 Thorens et al.
2011/0168172 A1 7/2011 Patton et al.
2011/0226236 A1* 9/2011 Buchberger ..... A61M 11/041 128/200.23
2011/0232654 A1 9/2011 Mass
2011/0245493 A1 10/2011 Rabinowitz et al.
2011/0253798 A1 10/2011 Tucker et al.
2011/0265806 A1 11/2011 Alarcon et al.
2011/0277756 A1 11/2011 Terry et al.
2011/0277757 A1 11/2011 Terry et al.
2011/0277760 A1 11/2011 Terry et al.
2011/0277761 A1 11/2011 Terry et al.
2011/0277764 A1 11/2011 Terry et al.
2011/0277780 A1 11/2011 Terry et al.
2011/0290244 A1 12/2011 Schennum
2011/0290266 A1* 12/2011 Koller ..... A24F 47/006 131/328
2011/0303231 A1 12/2011 Li et al.
2011/0304282 A1 12/2011 Li et al.
2011/0315152 A1 12/2011 Hearn et al.
2012/0006342 A1 1/2012 Rose et al.
2012/0090629 A1* 4/2012 Turner ..... A61M 15/06 131/273
2012/0111347 A1 5/2012 Hon
2012/0118301 A1 5/2012 Montaser
2012/0145169 A1 6/2012 Wu
2012/0167906 A1 7/2012 Gysland
2012/0174914 A1 7/2012 Pirshafiey et al.
2012/0186594 A1 7/2012 Liu
2012/0199146 A1* 8/2012 Marangos ..... A24F 47/008 131/328
2012/0199663 A1 8/2012 Qiu
2012/0211015 A1 8/2012 Li et al.
2012/0230659 A1 9/2012 Goodman et al.
2012/0260927 A1 10/2012 Liu
2012/0285475 A1 11/2012 Liu
2012/0312313 A1 12/2012 Frija
2012/0318882 A1 12/2012 Abehasera
2013/0014772 A1 1/2013 Liu
2013/0019887 A1 1/2013 Liu
2013/0025609 A1 1/2013 Liu
2013/0037041 A1 2/2013 Worm et al.
2013/0042865 A1 2/2013 Monsees et al.
2013/0056013 A1 3/2013 Terry et al.
2013/0192615 A1 8/2013 Tucker et al.
2013/0192616 A1 8/2013 Tucker et al.
2013/0192619 A1 8/2013 Tucker et al.
2013/0192620 A1 8/2013 Tucker et al.
2013/0192621 A1 8/2013 Li et al.
2013/0192622 A1 8/2013 Tucker et al.
2013/0192623 A1 8/2013 Tucker et al.
2013/0213416 A1 8/2013 Ahmet
2013/0213419 A1* 8/2013 Tucker ..... A24F 47/008 131/328
2013/0220315 A1 8/2013 Conley et al.
2013/0284192 A1 10/2013 Peleg et al.
2013/0298905 A1 11/2013 Levin et al.
2013/0319407 A1 12/2013 Liu
2014/0261488 A1* 9/2014 Tucker ..... A24F 47/008 131/328
2014/0290650 A1* 10/2014 Ivey ..... A24F 47/008 128/202.21
2015/0027468 A1* 1/2015 Li ..... A24F 47/008 131/329

FOREIGN PATENT DOCUMENTS

CN 87104459 A 2/1988
CN 1222089 A 7/1999
CN 1323231 A 11/2001
CN 1541577 11/2004
CN 2719043 Y 8/2005
CN 2777995 Y 5/2006
CN 101116542 A 2/2008
CN 201018927 Y 2/2008
CN 201029436 Y 3/2008
CN 201054977 Y 5/2008
CN 201067079 Y 6/2008
CN 201076006 Y 6/2008
CN 201085044 Y 7/2008
CN 101518361 A 9/2009
CN 201379072 Y 1/2010
CN 201709398 U 1/2011
CN 201789924 U 4/2011
CN 201797997 U 4/2011
CN 102106611 A 6/2011
CN 201860753 U 6/2011
CN 102166044 A 8/2011
CN 202014571 10/2011
CN 202014572 U 10/2011
CN 202026804 U 11/2011
CN 202233005 U 5/2012
CN 202233007 U 5/2012
DE 3640917 A1 8/1988
DE 3735704 A1 5/1989
DE 19854009 A1 5/2000
EP 0893071 A1 7/1908
EP 0277519 A2 8/1988
EP 0295122 A2 12/1988
EP 0358 002 A2 3/1990
EP 0358114 A2 3/1990
EP 0430566 A2 6/1991
EP 0845220 A1 6/1998
EP 0857431 A1 8/1998
EP 1989946 A1 11/2008
EP 2022350 A1 2/2009
EP 2113178 A1 11/2009
EP 2460424 A1 6/2012
EP 2481308 A1 8/2012
GB 680815 A 10/1952
GB 2148079 A 5/1985
JP 61068061 A 4/1986
JP 2000510763 A 8/2000
JP 2002527153 A 8/2002
JP 2005511178 A 4/2005
JP 2006320286 A 11/2006
JP 2006524494 A 11/2006
KR 100636287 B1 10/2006
NL 8201585 A 11/1982
WO WO-86/02528 A1 5/1986

(56) References Cited

FOREIGN PATENT DOCUMENTS

| | | | |
|---|---|---|---|
| WO | WO-9003224 | A1 | 4/1990 |
| WO | WO-95/02970 | A1 | 2/1995 |
| WO | WO-00/28843 | A1 | 5/2000 |
| WO | WO-03037412 | A2 | 5/2003 |
| WO | WO-2004/080216 | A1 | 9/2004 |
| WO | WO-2004/095955 | A1 | 11/2004 |
| WO | WO-T2005/053444 | A1 | 6/2005 |
| WO | WO-2005/099494 | A1 | 10/2005 |
| WO | WO-2007/066374 | A1 | 6/2007 |
| WO | WO-2007/078273 | A1 | 7/2007 |
| WO | WO-2007/098337 | A2 | 8/2007 |
| WO | WO-2007/131449 | A1 | 11/2007 |
| WO | WO-2007/131450 | A1 | 11/2007 |
| WO | WO-2007/141668 | A2 | 12/2007 |
| WO | WO-2008/055423 | A1 | 5/2008 |
| WO | WO-2010/091593 | A1 | 8/2010 |
| WO | WO-2010/145468 | A1 | 12/2010 |
| WO | WO-2011/124033 | A1 | 10/2011 |
| WO | WO-2011/125058 | A1 | 10/2011 |
| WO | WO-2011/146372 | A2 | 11/2011 |
| WO | WO-2012/129787 | A1 | 10/2012 |
| WO | WO-2012/142293 | A2 | 10/2012 |
| WO | WO-20121129812 | A1 | 10/2012 |

OTHER PUBLICATIONS

Further Examination Report dated Sep. 8, 2016 in related New Zealand Application No. 628789.

International Search Report and Written Opinion for PCT/US13/24228 dated Apr. 9, 2013.

International Search Report and Written Opinion for PCT/US13/24211 dated Apr. 19, 2013.

International Search Report and Written Opinion for PCT/USI3/24219 dated Apr. 22, 2013.

International Search Report and Written Opinion for PCT/US13/24229 dated Apr. 22, 2013.

International Search Report and Written Opinion for PCT/US13/24215 dated Apr. 22, 2013.

International Search Report and Written Opinion for PCT/US13/24222 dated Apr. 24, 2013.

International Search Report and Written Opinion for PCT/US13/27424 dated Apr. 25, 2013.

International Search Report and Written Opinion for PCT/US13/27432 dated May 2, 2013.

International Search Report and Written Opinion for PCT/US13/24224 dated May 13, 2013.

U.S. Appl. No. 13/843,028, filed Mar. 15, 2013, to Fath et al.

U.S. Appl. No. 131843,449, filed Mar. 15, 2013, to Fath et al.

International Preliminary Report on Patentability dated Sep. 4, 2014 for PCT/US2013/027424.

Lee et al., "Technique for aerosol generation with controllable micrometer size distribution," Chemosphere 73 (2008), pp. 760-767.

International Search Report and Written Opinion for PCT/US2013/022330 dated Jul. 15, 2014.

European Search Report for European Patent Application No. 13751154.9, dated Sep. 9, 2015.

Office Action from corresponding Chinese Patent Application 201380010758.7, dated Nov. 17, 2015.

U.S. Appl. No. 13/843,314, filed Mar. 15, 2013, to Fath et al.

Office Action from corresponding Chinese patent application 201380010758.7, dated Dec. 8, 2016, with English translation.

Malaysian Office Action dated Dec. 29, 2017 in Malaysian Application No. PI 2014002423.

* cited by examiner

ELECTRONIC SMOKING ARTICLE

CROSS REFERENCE TO RELATED APPLICATIONS

This application is a Divisional of U.S. patent application Ser. No. 13/774,364, filed Feb. 22, 2013, which claims priority under 35 U.S.C. § 119(e) to U.S. Provisional Application No. 61/601,903, filed on Feb. 22, 2012, the entire contents of each of which are herein incorporated by reference in their entirety.

WORKING ENVIRONMENT

Many of the embodiments disclosed herein include electronic cigarettes and cigars which include heated capillary aerosol generators and manually operative arrangements to deliver liquid from a liquid supply source to the capillary while the capillary is being heated. The heated capillary volatilizes a liquid such as by way of the teachings set forth in U.S. Pat. No. 5,743,251, which is incorporated herein in its entirety by reference thereto.

SUMMARY OF SELECTED FEATURES

An electronic cigarette comprises an outer cylindrical housing extending in a longitudinal direction, a liquid supply formed of an elastomeric material and containing a liquid material, a capillary tube having an inlet and an outlet, the inlet in communication with the outlet of the liquid supply, a power supply operable to apply voltage across a heater operable to heat the capillary tube to a temperature sufficient to at least initially volatilize liquid material contained within the capillary tube, a mixing chamber downstream of the capillary tube and at least one air inlet operable to deliver air drawn into the mixing chamber. The liquid supply is at least partially contained within the outer cylindrical housing and includes an outlet. The liquid supply is adapted to be compressed so as to pump liquid material from the liquid supply and through the outlet. The heater is adapted to be activated when the liquid supply is compressed so as to heat the capillary tube. Air mixed with the volatilized liquid material in the mixing chamber forms an aerosol The electronic cigarette can also include a mouth-end insert having at least one outlet. The mouth-end insert is in fluid communication with the mixing chamber so as to deliver aerosol to a smoker.

DETAILED DESCRIPTION

An electronic cigarette provides a flexible and/or compressible liquid supply, which is squeezed by a smoker to simultaneously pump liquid from the liquid supply to a capillary tube and activate a heater. Optionally, the electronic cigarette can include a check valve to limit the amount of liquid that can be pumped with each compression of the liquid supply and/or to prevent drawback of air into the liquid supply. Thus, the electronic cigarette is manually controlled and does not need an electromechanical pump, thereby extending battery life. Moreover, the use of a manual pump and capillary tube removes the need for a wick or other fibrous material in the electronic cigarette which may become entrained in the air path. In addition, a manual pump allows for the supply of liquid to the capillary tube for as long as the smoker applies pressure to the liquid supply. Thus, the continuity of the sensorial experience is maintained because the smoker is supplied with the same flavor from start to finish based on smoker preference. Moreover, the use of a capillary tube in an electronic cigarette allows for positioning of air inlets downstream of the heater so as to reduce temperature fluctuations at the heater. Finally, the electronic cigarette provides a sealed liquid supply that protects the liquid formulation contained therein from the atmosphere until use so as to avoid evaporation and/or degradation.

Figure 1:
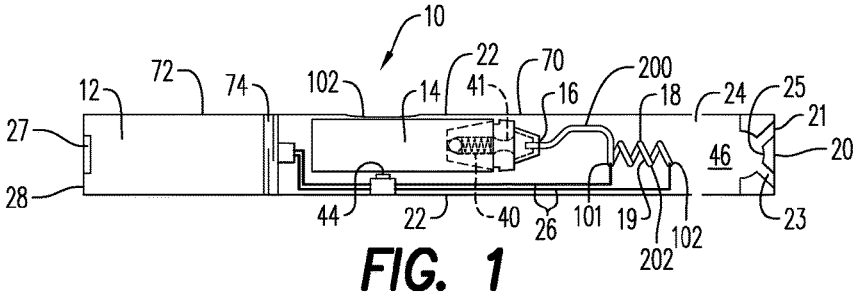
FIG. 1 is a cross-sectional view of an electronic cigarette according to a first embodiment.

As shown in FIG. 1, an electronic cigarette 10 comprises a replaceable cartridge (or first section) 70 and a reusable fixture (or second section) 72, which are coupled together at a threaded joint 74 or by other convenience such as a snug-fit, snap-fit, detent, clamp and/or clasp. The first section 70 can house a mouth-end insert 20, a capillary tube 18, a heater 19 to heat at least a portion of the capillary tube 18 (which may comprise a heatable portion 19 of the capillary tube 18 itself) and a liquid supply 14. The second section 72 can house a power supply 12 and control circuitry. The threaded portion 74 of the section 72 can be connected to a battery charger when not connected to the first section 70 for use so as to charge the battery.

Figure 5:
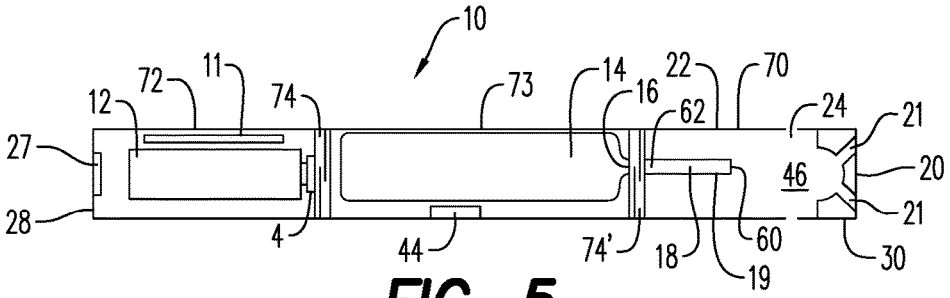
FIG. 5 is a cross-sectional view of the electronic cigarette of FIG. 2.
Figure 6:
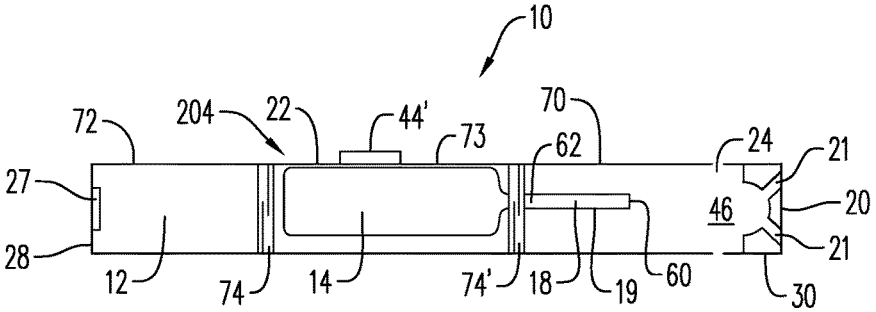
FIG. 6 is a cross-sectional view of an electronic cigarette according to a third embodiment.

In an alternative embodiment, as shown in FIGS. 2, 3, 5, 6 and 7, the electronic cigarette 10 can also include a middle section (third section) 73, which can house only the liquid supply 14. The middle section 73 can be adapted to be fitted with a threaded joint 74' at an upstream end of the first section 70 and a threaded joint 74 at a downstream end of the second section 72, as shown in FIGS. 5 and 6. In this embodiment, the first section 70 houses the heated capillary tube 18 and mouth-end insert 20, while the second section 72 houses the power supply 12.

Preferably, the first section 70, second section 72 and optional third section 73 include an outer cylindrical housing 22 extending in a longitudinal direction along the length of the electronic cigarette 10. Preferably, the outer cylindrical housing 22 is elastomeric so as to be flexible and/or compressible such that the smoker can apply pressure and/or squeeze the liquid supply 14 to pump liquid to the capillary tube 18 and activate the heater.

Figure 2:
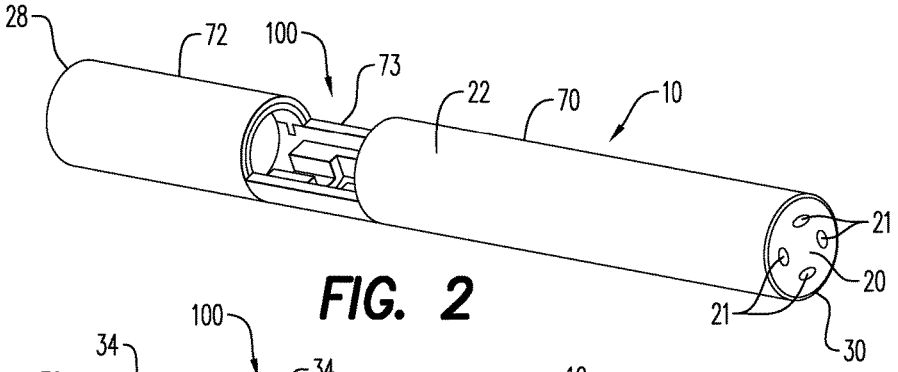
FIG. 2 is a perspective view of the electronic cigarette according to a second embodiment.
Figure 3:
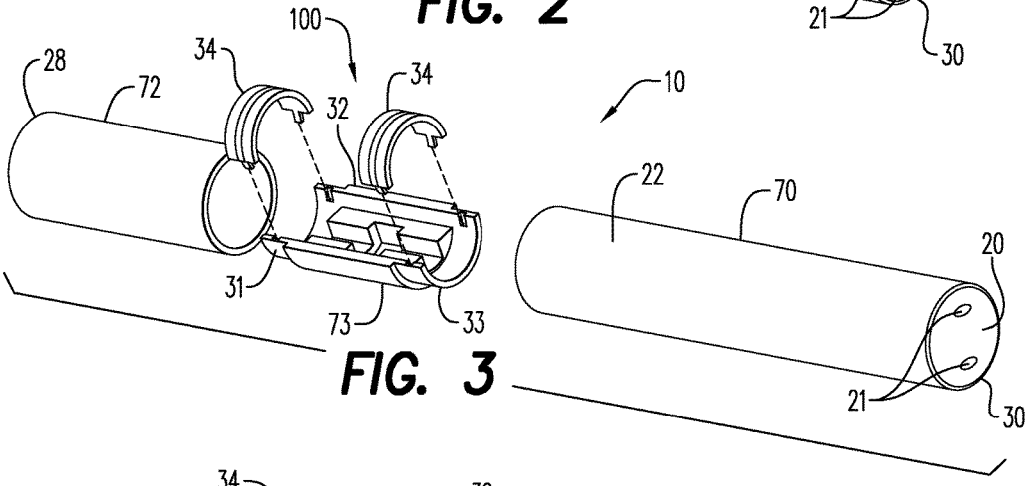
FIG. 3 is an exploded view of the electronic cigarette of FIG. 2.
Figure 7:
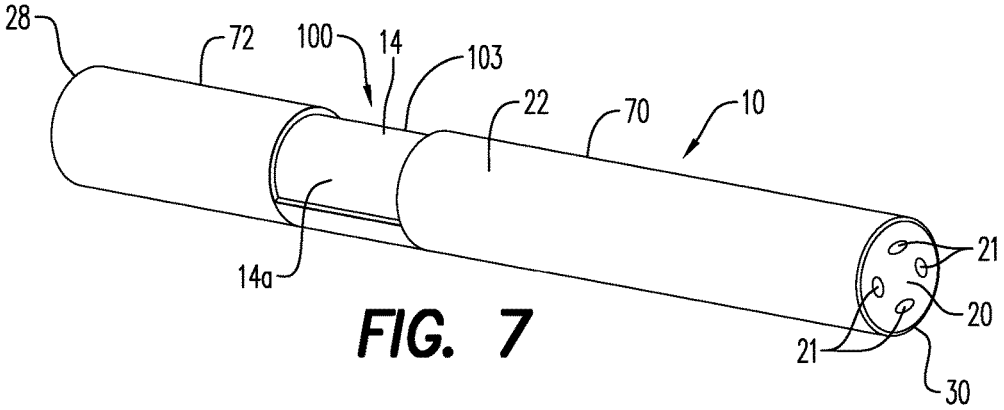
FIG. 7 is a perspective view of the electronic cigarette of FIG. 2 including a liquid supply.

As shown in FIGS. 2, 3 and 7, the outer cylindrical housing 22 can include a cutout 100 which allows a smoker to directly contact the liquid supply 14. Thus, the liquid supply 14 is designed to be part of the outer cylindrical housing 22 so that the outer cylindrical housing 22 is substantially continuous along the length thereof. A wall **14*a* of the liquid supply 14 can form a portion of the outer cylindrical housing 22 of the electronic cigarette. Preferably, the electronic cigarette is formed so that the diameter of the electronic cigarette is substantially uniform along the length thereof. When the liquid supply 14 forms a portion of the outer cylindrical housing 22, the remainder of the outer cylindrical housing 22** can be substantially rigid or elastomeric.

Alternatively, as shown in FIG. 6, the outer cylindrical housing 22 is substantially continuous along the length thereof and can be rigid. A pressure activated switch 44' can be positioned on an outer surface of the outer cylindrical housing 22, which acts to apply pressure to the liquid supply 14 and simultaneously activates the heater. In this embodiment, the liquid supply 14 is formed of an elastomeric material so that upon application of manual pressure to the pressure switch, pressure is also applied to a side of the liquid supply 14 so as to force liquid through the outlet 16 of the liquid supply 14 to the capillary tube 18. By applying manual pressure to the pressure switch, the power supply is activated and an electric current heats the liquid in the capillary tube 18 via electrical contacts so as to volatilize the liquid.

As shown in FIG. 1, in another embodiment, the outer cylindrical housing 22 can be flexible along the length thereof and fully cover the liquid supply 14. In use, a smoker can apply pressure to the outer cylindrical housing 22 adjacent the liquid supply 14 so as to pump the liquid and simultaneously apply pressure to a pressure switch, which activates the control circuitry and causes the power supply to send an electric current to the heat the heater. In one embodiment, a depression 102 can be formed in the outer cylindrical housing 22 to indicate where the smoker should apply pressure. The depression 102 can extend fully or partially about the circumference of the outer cylindrical housing 22.

In one embodiment, the middle section 73 is disposable and the first section 70 and/or second section 72 is reusable. In another embodiment, the first section 70 can also be replaceable so as to avoid the need for cleaning the capillary tube 18. The sections 70, 72, 73 can be attached by a threaded connection whereby the middle section 73 can be replaced when the liquid supply 14 is used up.

In the preferred embodiment, the liquid supply 14 is a tubular, elongate body formed of an elastomeric material so as to be flexible and/or compressible when squeezed. Preferably, the elastomeric material can be selected from the group consisting of silicone, plastic, rubber, latex, and combinations thereof.

Preferably, the compressible liquid supply 14 has an outlet 16 which is in fluid communication with a capillary tube 18 so that when squeezed, the liquid supply 14 can deliver a volume of liquid material to the capillary tube 18. Simultaneous to delivering liquid to the capillary, the power supply 12 is activated upon application of manual pressure to the pressure switch and the capillary tube 18 is heated to form a heated section wherein the liquid material is volatilized. Upon discharge from the heated capillary tube 18, the volatilized material expands, mixes with air and forms an aerosol.

Preferably, the liquid supply 14 extends longitudinally within the outer cylindrical housing 22 of the first section 70 (shown in FIG. 1) or the middle section 73 (shown in FIG. 5). Moreover, the liquid supply 14 comprises a liquid material which is volatilized when heated and forms an aerosol when discharged from the capillary tube 18.

In the preferred embodiment, the capillary tube 18 includes an inlet end 62 in fluid communication with the outlet 16 of the liquid supply 14, and an outlet end 60 (shown in FIGS. 5 and 6) operable to expel volatilized liquid material from the capillary tube 18.

Preferably, the capillary tube 18 has an internal diameter of 0.01 to 10 mm, preferably 0.05 to 1 mm, and more preferably 0.05 to 0.4 mm. For example, the capillary tube can have an internal diameter of about 0.05 mm. Capillary tubes of smaller diameter provide more efficient heat transfer to the fluid because, with the shorter the distance to the center of the fluid, less energy and time is required to vaporize the liquid. Alternatively, the capillary tube has an internal cross sectional area of $8\times10^{-5}$ to 80 $mm^2$, preferably 0.002 to 0.8 $mm^2$, more preferably 0.002 to 0.05 $mm^2$. For example, the capillary tube can have an internal cross sectional area of about 0.002 $mm^2$.

Also preferably, the capillary tube 18 may have a length of about 5 mm to about 72 mm, more preferably about 10 mm to about 60 mm or about 20 mm to about 50 mm. For example, the capillary tube 18 can be about 50 mm in length and arranged such that a downstream, about 40 mm long portion of the capillary tube 18 forms a heated section 202 and an upstream, about 10 mm long portion 200 of the capillary tube 18 remains relatively unheated when the heater 19 is activated (shown in FIG. 1).

In one embodiment, the capillary tube 18 is substantially straight. In other embodiments, the capillary tube 18 is coiled and/or includes one or more bends therein to conserve space.

In the preferred embodiment, the capillary tube 18 is formed of a conductive material, and thus acts as its own heater 19 by passing current through the tube. The capillary tube 18 may be any electrically conductive material capable of being resistively heated, while retaining the necessary structural integrity at the operating temperatures experienced by the capillary tube 18, and which is non-reactive with the liquid material. Suitable materials for forming the capillary tube 18 are selected from the group consisting of stainless steel, copper, copper alloys, porous ceramic materials coated with film resistive material, Inconel® available from Special Metals Corporation, which is a nickel-chromium alloy, Nichrome®, which is also a nickel-chromium alloy, and combinations thereof.

In one embodiment, the capillary tube 18 is a stainless steel capillary tube 18, which serves as a heater 19 via electrical leads 26 attached thereto for passage of direct or alternating current along a length of the capillary tube 18. Thus, the stainless steel capillary tube 18 is heated by resistance heating. The stainless steel capillary tube 18 is preferably circular in cross section. The capillary tube 18 may be of tubing suitable for use as a hypodermic needle of various gauges. For example, the capillary tube 18 may comprise a 32 gauge needle has an internal diameter of 0.11 mm and a 26 gauge needle has an internal diameter of 0.26 mm.

In another embodiment, the capillary tube 18 may be a non-metallic tube such as, for example, a glass tube. In such an embodiment, the heater 19 is formed of a conductive material capable of being resistively heated, such as, for example, stainless steel, Nichrome® or platinum wire, arranged along the glass tube. When the heater arranged along the glass tube is heated, liquid material in the capillary tube 18 is heated to a temperature sufficient to at least partially volatilize liquid material in the capillary tube 18.

Preferably, at least two electrical leads 26 are bonded to a metallic capillary tube 18. In the preferred embodiment, the at least two electrical leads 26 are brazed to the capillary tube 18. Preferably, one electrical lead 26 is brazed to a first, upstream portion 101 of the capillary tube 18 and a second electrical lead 26 is brazed to a downstream, end portion 102 of the capillary tube 18, as shown in FIG. 1.

In use, once the capillary tube 18 is heated, the liquid material contained within a heated portion of the capillary tube 18 is volatilized and ejected out of the outlet 60 (shown in FIGS. 5 and 6) where it expands and mixes with air and forms an aerosol in a mixing chamber 46.

Preferably, the electronic cigarette 10 also includes at least one air inlet 24 operable to deliver air to the mixing chamber 46. Preferably, the air inlets 24 to the mixing chamber 46 are arranged downstream of the capillary tube 18 so as to minimize drawing air along the capillary tube and thereby avoid cooling of the capillary tube 18 during heating cycles. In use, the volatilized material expands out of the capillary tube 18 and into the mixing chamber 46 where it can mix with air to form an aerosol which is then drawn through the mouth-end insert 20. In the preferred embodiment, the at least one air inlet 24 includes one or two air inlets. Alternatively, there may be three, four, five or more air inlets. Altering the size and number of air inlets 24 can also aid in establishing the resistance to draw of the electronic cigarette 10.

Preferably, the capillary tube 18 is spaced sufficiently apart from the mouth-end of the electronic cigarette 10 to protect it and a smoker's fingers from each other should the mouth-end insert 20 be removed.

In the preferred embodiment, the liquid supply 14 may include a check valve 40, shown in FIG. 1. The check valve 40 is operable to maintain the liquid material within the liquid supply, but opens when the liquid supply 14 is squeezed and pressure is applied. Preferably, the check valve 40 opens when a critical, minimum pressure is reached so as to avoid inadvertent dispensing of liquid material from the liquid supply 14 or activating the heater 19. Preferably, the critical pressure needed to open the check valve 40 is essentially equal to or slightly less than the pressure required to press a pressure switch 44 to activate the heater 19. Preferably, the pressure required to press the pressure switch 44 is high enough such that accidental heating is avoided. Such arrangement avoids activation of the heater 19 in the absence of liquid being pumped through the capillary.

Advantageously, the use of a check valve 40 also aids in limiting the amount of liquid that is drawn back from the capillary upon release of pressure upon the liquid supply 14 (and/or the switch 44). Withdrawal of liquid from the capillary at conclusion of a puff (or activation) is desirous. The presence of residual liquid in the capillary at the initiation of a new puff cycle can lead to undesirable sputtering of liquid from the heated capillary at the beginning of activation. Withdrawing the liquid via "drawback" as a result of the supply bladder 14 returning to toward its original, uncompressed state can avoid such sputtering, but can, if left unchecked, lead to air being drawn into the liquid supply bladder 14. Presence of air degrades pumping performance of the supply bladder. Use of a check valve 40 can be configured to allow a desired, limited amount of drawback to occur, such that drawback of liquid occurs without air being not drawn into the supply bladder 14. Such arrangement may be achieved by adjusting the size or the closing action of the check valve shown in FIG. 1.

Once pressure upon the liquid supply 14 is relieved, the check valve 40 closes. The heated capillary tube 18 discharges liquid remaining downstream of the check valve 40. Advantageously, the capillary tube 18 is purged once a smoker has stopped compressing the liquid supply 14 because any liquid remaining in the tube is expelled during heating.

The check valve is a one-way or non-return valve, which allows the liquid to flow in a single direction so as to prevent backflow or liquid and air bubbles in the liquid supply. The check valve can be a ball check valve, a diaphragm check valve, a swing check valve, a stop-check valve, a lift-check valve, an in-line check valve or a duckbill valve. To assure purging, the heating cycle may be extended by a controlled amount beyond release of pressure on the switch 44 and/or closure of the check valve 40.

Optionally, a critical flow orifice 41 is located downstream of the check valve 40 to establish a maximum flow rate of liquid to the capillary tube 18.

Adjacent the liquid supply 14 is the pressure switch 44. The pressure switch 44 is positioned such that when the liquid supply 14 is squeezed, the pressure switch 44 communicates with the control circuitry to supply power and activate the heater 19 which in turn heats the capillary tube 18 to volatilize the liquid material therein.

In one embodiment, as shown in FIG. 6, the pressure switch 44' can be located on an outer surface 204 of the electronic cigarette 10 and the pressure switch 44' is pressed to activate the heater 19 and squeeze the liquid supply 14. The control circuitry is integrated with the pressure switch 44 and supplies power to the heater 19 responsive to pressing the pressure switch. Preferably, the pressure switch 44, 44' is adjacent the liquid supply 14 so that a single action is needed to simultaneously activate the heater 19 and supply liquid to the capillary tube 18.

Figure 4:
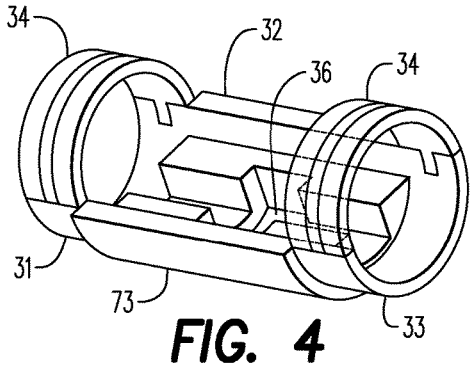
FIG. 4 is an enlarged view, top view of a fitting operable to hold a liquid supply containing liquid within the electronic cigarette of FIGS. 2 and 3.

As shown in FIGS. 3 and 4, the liquid 14 can be held within a fitting 32. The fitting 32 can include a recess 36 into which the pressure switch 44 is recessed. Clamps 34 hold the liquid supply 14 within the fitting 32. Each end 31, 33 of the fitting 32 can be threaded or otherwise configured to mate with the first section 70 and the second section 72 of the electronic cigarette 10. When the fitting 32 is used, the liquid supply 14 can be configured to be removable and replaceable once the liquid supply is used. Thus, a new liquid supply 14 could be secured within the fitting 32 for continued smoking.

In the preferred embodiment, the power supply 12 includes a battery arranged in the electronic cigarette 10 such that the anode is downstream of the cathode. A battery anode connector 4 (shown in FIG. 5) contacts the downstream end of the battery. The heater 19 can be connected to the battery by two spaced apart electrical leads 26 (also shown in FIG. 1). The power supply 12 is operable to apply voltage across the heater 19 associated with the capillary tube 18 and volatilize liquid material contained therein according to a power cycle of either a predetermined time period, such as a 5 second period, or for so long as pressure is applied to the liquid supply 14 and/or the pressure activated switch 44.

Preferably, the electrical contacts or connection between the heater 19 and the electrical leads 26 are highly conductive and temperature resistant while the heatable portion 19 of the capillary tube 18 is highly resistive so that heat generation occurs primarily along the heater 19 and not at the contacts.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic cigarette 10 is usable by a smoker until the energy in the power supply is depleted. Alternatively, the power supply 12 may be rechargeable and include circuitry allowing the battery to be chargeable by an external charging device. In that case, preferably the circuitry, when charged, provides power for a pre-determined number of puffs, after which the circuitry must be re-connected to an external charging device.

Preferably, the electronic cigarette 10 also includes control circuitry which can be on a printed circuit board 11. Once the pressure switch is pressed, the power supply is activated and supplies power to the heater 19. The control circuitry 11 can also include a heater activation light 27 operable to glow when the heater 19 is activated. Preferably, the heater activation light 27 comprises an LED and is at an upstream end 28 of the electronic cigarette 10 so that the heater activation light 27 takes on the appearance of a burning coal during a puff. Moreover, the heater activation light 27 can be arranged to be visible to the smoker. In addition, the heater activation light 27 can be utilized for cigarette system diagnostics. The light 27 can also be configured such that the smoker can activate and/or deactivate the light 27 when desired, such that the light 27 would not activate during smoking if desired.

The control circuitry 11 is integrated with the pressure switch 44 and supplies power to the heater 19 of the capillary tube 18 responsive to pressing the pressure switch 44, preferably with a maximum, time-period limiter (e.g. a timing circuit). The control circuitry 11 also includes a timer operable to limit the time for which power is supplied to the heater 19.

The time-period of the electric current supply to the heater 19 may be pre-set depending on the amount of liquid desired to be vaporized. The control circuitry 11 can be programmable for this purpose. The control circuitry can be an application specific integrated circuit (ASIC).

Preferably, when activated, the heater 19 heats a portion of the capillary tube 18 for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

In the preferred embodiment, the liquid supply 14 includes a liquid material which has a boiling point suitable for use in the electronic cigarette 10. If the boiling point is too high, the heater 19 will not be able to vaporize liquid in the capillary tube 18. However, if the boiling point is too low, the liquid may vaporize without the heater 19 being activated.

Preferably, the liquid material includes a tobacco-containing material including volatile tobacco flavor compounds which are released from the liquid upon heating. The liquid may also be a tobacco flavor containing material and/or a nicotine-containing material. Alternatively, or in addition, the liquid may include a non-tobacco material and/or may be nicotine-free. For example, the liquid may include water, solvents, ethanol, plant extracts and natural or artificial flavors. Preferably, the liquid further includes an aerosol former. Examples of suitable aerosol formers are glycerine and propylene glycol.

In use, liquid material is transferred from the liquid supply 14 to the heated capillary tube 18 by manual pumping caused by squeezing of the liquid supply 14.

As shown in FIGS. 1, 5 and 6 the electronic cigarette 10 further includes a mouth-end insert 20 having at least two off-axis, preferably diverging outlets 21. Preferably, the mouth-end insert 20 is in fluid communication with the mixing chamber 46 and includes at least two diverging outlets 21. (e.g, 3, 4, 5, or preferably 6 to 8 outlets or more). Preferably, the outlets 21 of the mouth-end insert 20 are located at ends of off-axis passages 23 and are angled outwardly in relation to the longitudinal direction of the electronic cigarette 10 (i.e., divergently). As used herein, the term "off-axis" denotes at an angle to the longitudinal direction of the electronic cigarette. Also preferably, the mouth-end insert (or flow guide) 20 includes outlets uniformly distributed around the mouth-end insert 20 so as to substantially uniformly distribute aerosol in a smoker's mouth during use. Thus, as the aerosol passes into a smoker's mouth, the aerosol enters the mouth and moves in different directions so as to provide a full mouth feel as compared to electronic cigarettes having an on-axis single orifice which directs the aerosol to a single location in a smoker's mouth.

In addition, the outlets 21 and off-axis passages 23 are arranged such that droplets of unaerosolized liquid material carried in the aerosol impact interior surfaces 25 of the mouth-end insert 20 and/or interior surfaces of the off-axis passages 23 such that the droplets are removed or broken apart. In the preferred embodiment, the outlets 21 of the mouth-end insert 20 are located at the ends of the off-axis passages 23 and are angled at 5 to 60° with respect to the central longitudinal axis of the electronic cigarette 10 so as to more completely distribute aerosol throughout a mouth of a smoker during use and to remove droplets.

Preferably, each outlet 21 has a diameter of about 0.015 inch to about 0.090 inch (e.g., about 0.020 inch to about 0.040 inch or about 0.028 inch to about 0.038 inch). The size of the outlets 21 and off-axis passages 23 along with the number of outlets 21 can be selected to adjust the resistance to draw (RTD) of the electronic cigarette 10, if desired.

As shown in FIG. 1, an interior surface 25 of the mouth-end insert 20 can comprise a generally domed surface. Alternatively, the interior surface 25 of the mouth-end insert 20 can be generally cylindrical or frustoconical, with a planar end surface. Preferably, the interior surface is substantially uniform over the surface thereof or symmetrical about the longitudinal axis of the mouth-end insert 20. However, in other embodiments, the interior surface can be irregular and/or have other shapes.

Preferably, the mouth-end insert 20 is affixed within the outer cylindrical housing 22 of the cartridge 72.

In a preferred embodiment, the electronic cigarette 10 is about the same size as a conventional cigarette. In some embodiments, the electronic cigarette 60 can be about 80 mm to about 110 mm long, preferably about 80 mm to about 100 mm long and about 7 mm to about 8 mm in diameter. For example, in an embodiment, the electronic cigarette is about 84 mm long and has a diameter of about 7.8 mm.

The outer cylindrical housing 22 of the electronic cigarette 10 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, low density polyethylene (LDPE) and high density polyethylene (HDPE). Preferably, the material is light and non-brittle. More preferably, at least a portion of the outer cylindrical housing 22 is elastomeric so as to allow a smoker to squeeze the liquid supply 14 during smoking to release liquid material therefrom and activate the heater 19. Thus, the outer cylindrical housing 22 can be formed of a variety of materials including plastics, rubber and combinations thereof. In a preferred embodiment, the outer cylindrical housing 22 is formed of silicone. The outer cylindrical housing 22 can be any suitable color and/or can include graphics or other indicia printed thereon.

In an embodiment, the volatilized material formed as described herein can at least partially condense to form an aerosol including particles. Preferably, the particles contained in the vapor and/or aerosol range in size from about 0.5 micron to about 4 microns, preferably about 1 micron to about 4 microns. In the preferred embodiment, the vapor and/or aerosol has particles of about 3.3 microns or less, more preferably about 2 nanometers (nm) or less. Also preferably, the particles are substantially uniform throughout the vapor and/or aerosol.

In another embodiment, in lieu of a pressure switch, a flow sensor could be arranged to detect flow being pumped to the capillary, and serve as the switch between the power source 12 and heater 19. Furthermore, a puff sensor could be added and coupled with the flow sensor such that signals from both, indicative of both liquid flow and a puff, would connect the battery to the heater 19.

The teachings herein are applicable to electronic cigars, and references to "electronic cigarette(s)" is intended to be inclusive of electronic cigars and the like. Moreover, references to "electronic smoking articles" is intended to be inclusive of electronic cigars, electronic cigarettes and the like.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic cigarette has been described in this specification with sufficient particularity as to be understood by one of ordinary skill in the art. Moreover, it will be apparent to those skilled in the art that numerous modifications, variations, substitutions, and equivalents exist for features of the electronic cigarette which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. A method of operating an electronic article, comprising:
providing the electronic article with,
a capillary tube,
a compressible liquid supply reservoir configured to contain a liquid, an outlet of the liquid supply reservoir being in communication with an inlet of the capillary tube, the liquid supply reservoir being formed from an elastomeric material,
a power source,
a pressure switch in electrical communication with the power supply,
an electrical heater operative upon the capillary tube:
operating a heated capillary tube by,
delivering the liquid to the capillary tube by manually communicating pressure to the compressible liquid supply reservoir;
activating the pressure switch to communicate electrical power from the power source to the electric heater, wherein the heated capillary tube discharges the liquid communicated to the capillary tube in an at least partially volatized condition;
the discharging including,
discharging the liquid into a chamber on an end of the capillary tube to produce a vapor; and
drawing the vapor from the chamber.

2. The method of claim 1, wherein the manually communicating pressure to a compressible liquid supply reservoir also communicates pressure to the pressure switch.

3. The method of claim 1, wherein the delivering liquid includes limiting liquid communication to pressures above a minimum pressure.

4. The method of claim 1, wherein the delivering liquid includes limiting liquid communication to a maximum flow rate.

5. The method of claim 1, wherein the producing vapor includes admitting air and mixing the admitted air with the discharged liquid, downstream of the heater.

6. The method of claim 1, wherein activating the pressure switch comprises sensing flow from the liquid supply reservoir.

7. The method of claim 1, wherein activating the pressure switch comprises sensing flow from the liquid supply reservoir simultaneously with sensing a puff.

8. The method of claim 1, wherein the providing the electronic article includes at least partially containing the liquid supply reservoir, the capillary tube and the heater within an outer cylindrical housing of the electronic article.

9. The method of claim 8, wherein the providing the electronic article includes defining at least one air inlet in the outer cylindrical housing near an outlet of the capillary tube.

10. The method of claim 8, wherein the providing the electronic article includes defining a cutout in the outer cylindrical housing that is superposed with a wall of the liquid supply reservoir, the cutout being configured to allow the manual compression of the liquid supply reservoir.

11. The method of claim 8, wherein the providing the electronic article includes defining a depression in the outer cylindrical housing that is superposed with a wall of the liquid supply reservoir, the depression being configured to indicate where to apply the manual compression of the liquid supply reservoir.

12. The method of claim 1, wherein the providing the electronic article includes making the capillary tube with an internal diameter of about 0.05 to 0.4 mm, and a length that is about 5 mm to 72 mm.

13. The method of claim 1, wherein the providing the electronic article includes making the capillary tube from one of a stainless steel tube and a non-metallic tube.

14. The method of claim 1, wherein the providing the electronic article includes positioning the pressures switch to be adjacent to the liquid supply reservoir such that the delivering of the liquid to the capillary tube includes manually compressing the liquid supply reservoir to also simultaneously cause the activating of the pressure switch.

15. The method of claim 1, wherein the providing the electronic article includes positioning the pressures switch to be adjacent to the liquid supply reservoir such that the activating of the pressure switch includes manually compressing the pressure switch to also simultaneously cause the delivering of the liquid to the capillary tube.

16. The method of claim 1, wherein the providing the electronic article includes positioning a check valve at the outlet of the liquid supply reservoir, the check valve being configured to open in response to the manual compression of the liquid supply reservoir.

17. The method of claim 1, wherein the providing the electronic article includes positioning an orifice at the outlet of the liquid supply reservoir, the orifice being configured to limit the delivery of the liquid to the capillary tube to a maximum flow rate.

18. The method of claim 1, wherein the providing the electronic article includes positioning the outlet of the liquid supply reservoir to be in direct communication with the inlet of the capillary tube.

* * * * *